US006053185A

United States Patent [19]

Beevers

[11] Patent Number: 6,053,185

[45] Date of Patent: Apr. 25, 2000

[54] DISHWASHER HAVING A DRYING MODE WITH JET-AIR INJECTION

[76] Inventor: Jerry P. Beevers, 2606 Lively La., Sugarland, Tex. 77479

[21] Appl. No.: 08/996,025

[22] Filed: Dec. 22, 1997

[51] Int. Cl.[7] ..... B08B 3/10

[52] U.S. Cl. ..... 134/56 D; 134/58 D; 134/102.3; 134/200; 34/565

[58] Field of Search ..... 134/95.2, 56 D, 134/57 D, 58 D, 102.3, 200, 95.1, 102.1; 239/552; 34/565, 181

[56] References Cited

U.S. PATENT DOCUMENTS

| | | | |
|---|---|---|---|
| 2,842,144 | 7/1958 | Lyman | 134/57 |
| 2,972,352 | 2/1961 | Ipsen | 134/57 |
| 4,354,514 | 10/1982 | Sundheimer | 134/152 |
| 4,941,490 | 7/1990 | Gross | 134/98 |
| 4,997,000 | 3/1991 | Feast | 134/170 |
| 5,076,306 | 12/1991 | Suzuki et al. | 134/95 |
| 5,080,283 | 1/1992 | Kukesh et al. | 239/9 |
| 5,277,210 | 1/1994 | Kim | 134/95.2 |
| 5,287,868 | 2/1994 | Tuller et al. | 134/95.2 |
| 5,355,900 | 10/1994 | Sakata | 134/95.2 |
| 5,381,957 | 1/1995 | Bianco | 239/99 |
| 5,533,359 | 7/1996 | Sutter | 134/95.2 |
| 5,601,100 | 2/1997 | Kawakami | 134/56 R |

*Primary Examiner*—Frankie L. Stinson
*Attorney, Agent, or Firm*—Joseph N. Breaux

[57] ABSTRACT

A dishwasher having a drying mode with jet-air injection comprising a washing chamber refined by a back wall, a top wall, a bottom floor, a first and second side walls and a dishwasher door; and, a jet-air injection system which injects during the drying mode to a plurality evenly distributed forceful streams of jet-air from an air manifold coupled to the top wall of the washing chamber. The air manifold comprises a plurality of parallelly spaced conduits, perpendicular to the back wall, each of which has formed therein a plurality of spaced air vents which expel downward therefrom the plurality of evenly distributed forceful streams of jet-air. The force of the plurality evenly distributed forceful streams of jet-air forces buildup of water collected in an indentation, cracks and crevices of upside down glasses, cups, and other dishes place in a top rack of the washing chamber out of she indentation, cracks and crevices and downward to the bottom floor of the washing chamber.

3 Claims, 3 Drawing Sheets

DISHWASHER HAVING A DRYING MODE WITH JET-AIR INJECTION

TECHNICAL FIELD

The present invention relates to dishwashers and, more particularly, to a dishwasher comprising a jet-air injection system for operation during a drying mode wherein the injection of the jet-air streams are directed downward from an air manifold having a plurality of spaced conduits each of which comprises a plurality of spaced air vents for expelling therefrom jet-air streams from the interior roof surface to the top rack of the dishwasher. Thereby, during the drying mode air, the injected jet-air streams are evenly distributed to the top rack of the dishwasher for faster drying of the dishes. Moreover, the force of the injected jet-air streams forces collected water out of the indentation found in upside down cups or between other cracks and crannies of the dishes and minimizes condensation.

BACKGROUND OF THE INVENTION

The top rack of dishwasher's are designed to store glasses, cups and small bowls, as well as, other items dimensioned to fit in the top rack. When filling the top rack, glasses and cups are turned upside down and placed in the top rack in a known manner. However, the bottom surface of glasses and cups, typically, are not completely flat but instead provide an indentation which tends to collect water therein.

Dishwashers typically have a drying mode which attempts to dry the dishes after the dishes have been washed and rinsed. During the drying mode air is circulated into the dishwasher's washing chamber. The circulated air is sufficient to dry beads of water dripping off the surfaces of plates, glasses, pot, etc. The problem with the traditional drying mode of dishwashers is that the collection of water in the indentation, cracks, crevices, of glasses, cups and other dishes does not dry. Thereby, when the user removes the glasses, cups and other dishes the water is spilled onto the dishes in the lower rack of the dishwasher. Thereby, the dishes after having been re-wet are dried manually prior to placement into the cabinet. It is not uncommon that the dishes on the top rack must be dried before placing such dishes away in the cabinet because of the excessive amount of residual water found on such dishes.

Several devices have been patented which are aimed at dishwashers with drying modes.

U.S. Pat. No. 5,355,900, by Sakata, entitled "DISHWASHER WITH DRYING CYCLE" discloses a dishwasher with a drying cycle having a fan for circulating air in the chamber. The fan is coupled to the rooftop surface of the chamber.

U.S. Pat. No. 5,287,868, by Tuller et al., entitled "DISHWASHER CONVECTION AIR INLET AND SUDS CONTROL DEVICE" discloses a convection air inlet and suds control device located in a corner of the bottom floor of the dishwasher. A container having an inner cup an outer cup wherein the inner cup surrounds the lower extension of a chimney. The outer cup includes an opening such that air may flow by convection into the outer cup.

U.S. Pat. No. 5,277,210, by Kim, entitled "DRYING DUCT OF DISHWASHER" discloses a flexible air duct connected to the dishwasher for conducting hot moist air therethrough. Hot air is discharged through an air outlet coupled to the side wall of the dishwasher.

U.S. Pat. No. 5,076,306, by Suzuki et al., entitled "DISHWASHER WITH DRYER" discloses a fan coupled to the upper part of the back wall of the dishwasher chamber for circulating air within the dishwasher chamber.

It can be readily seen that there exists the continuing need for a dishwasher comprising a jet-air injection system for operation during a drying mode wherein the injection of the jet-air are directed downward from an air manifold having a plurality of spaced conduits each of which comprises a plurality of spaced air vents for expelling therefrom jet-air streams from the interior roof surface to the top rack of the dishwasher. Thereby, during the drying mode air, the injected jet-air streams are evenly distributed to the top rack of the dishwasher for faster drying or the dishes. Moreover, the force of the injected jet-air streams forces collected water out of the indentation found in upside down cups or between other cracks and crannies of the dishes and minimizes condensation.

SUMMARY OF THE INVENTION

The preferred embodiment of the dishwasher of the present invention solves the aforementioned problems in a straight forward and simple manner. What is provided is a dishwasher comprising a jet-air injection system for operation during a drying mode wherein the injection of the jet-air streams are directed downward from an air manifold having a plurality of spaced conduits each of which comprises a plurality of spaced air vents for expelling therefrom jet-air streams from the interior roof surface to the top rack of the dishwasher. Thereby, during the drying mode air, the injected jet-air steams are evenly distributed to the top rack of the dishwasher for faster drying of the dishes. Moreover, the force of the injected jet-air streams forces collected water out of the indentation found in upside down cups or between other cracks and crannies of the dishes and minimizes condensation.

The dishwasher having a drying mode with jet-air injection, of the present invention, comprises: a washing chamber defined by a back wall, top wall, bottom floor, first and second side walls and dishwasher door; and, a jet-air injection system which injects during said drying mode to a plurality evenly distributed forceful streams of jet-air from an air manifold coupled to said top wall of said washing chamber, wherein said air manifold comprises a plurality of parallelly spaced conduits perpendicular to said back wall or alternatively, to the first side wall or second side wall, each of which has formed therein a plurality of spaced air vents which expel downward therefrom said plurality of evenly distributed forceful streams of jet-air.

The force of said plurality evenly distributed forceful streams of jet-air forces buildup of water collected in an indentation, cracks and crevices of upside down glasses, cups, and other dishes place in a top rack of said washing chamber out of the indentation, cracks and crevices and downward to said bottom floor of said washing chamber.

In view of the above, an object of the present invention is to provide a dishwasher with an air injection system which serves to distribute air in the washing chamber more evenly for enhancing the speed of drying of the washed dishes throughout the washing chamber.

Another object of the present invention is to provide such an air injection system with jet-air streams having a sufficient force to force the buildup of water collected in an indentation of upside down glasses, cup, etc. and water collected in cracks and crevices out of the indentation, crack and/or crevices and downward to the bottom floor of the dishwasher chamber. Thereby, the otherwise collected water is substantially eliminated so that when removing glasses, cups and other dishes frog the top rack, dishes immediately below the top rack do not become wet and the glasses, cups and other dishes from the top rack do not require further drying.

A further object of the present invention is to provide an air injection system which can be turned on automatically during the dishwasher's preexisting drying mode.

It is a still further object of the present invention to provide an air injection system which injects jet-air streams during the drying mode so as to enhance the drying of the dishes during the preexisting drying mode.

It is a still further object of the present invention to provide an enhanced drying mode for dishwashers wherein the evenly distributed jet-air streams significantly minimizes, if not, eliminates residual water often found after the completion of preexisting drying modes.

It is a still further object of the present invention to provide an enhanced drying mode for dishwashers which significantly minimizes, if not, eliminates spots on the dishes which results from drying residual water.

It is a still further object of the present invention to provide an air injection system which comprises an air compressor, a compressed air storage tank, an air injection manifold, and an air distribution conduits coupled between the compressed air storage tank and the air injection manifold.

It is a still further object of the present invention to provide a compressed air storage tank which outputs continuous jets of air stream therefrom wherein the force of such air streams forces the buildup of water collected in an indentation of upside down glasses, cup, etc., out of the indentation and downward to the bottom floor of the washing chamber.

Alternatively, it is an object of the present invention to provide a compressed air storage tank which outputs oscillating or bursts of air therefrom wherein the force of such bursts of air injection forces the buildup of water collected in an indentation of upside down glasses, cup, etc., out of the indentation and downward to the bottom floor of the dishwasher chamber.

It is a still further object of the present invention to provide a dishwasher with jet-air injection for enhancing the drying of the dishes during the drying mode.

It is still further object of the invention to provide the air manifold with spray nozzles which expel therefrom clusters of air-jet streams for enhancing the dispersion of the injected air to the dishes in the top rack of the washing chamber of the dishwasher.

In view of the above objects, it is a feature of the present invention to provide a an air injection system which is simple to manufacture.

Another feature of the present invention is to provide an air injection system for use with readily available dishwashers by various manufactures which is relatively simple structurally.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
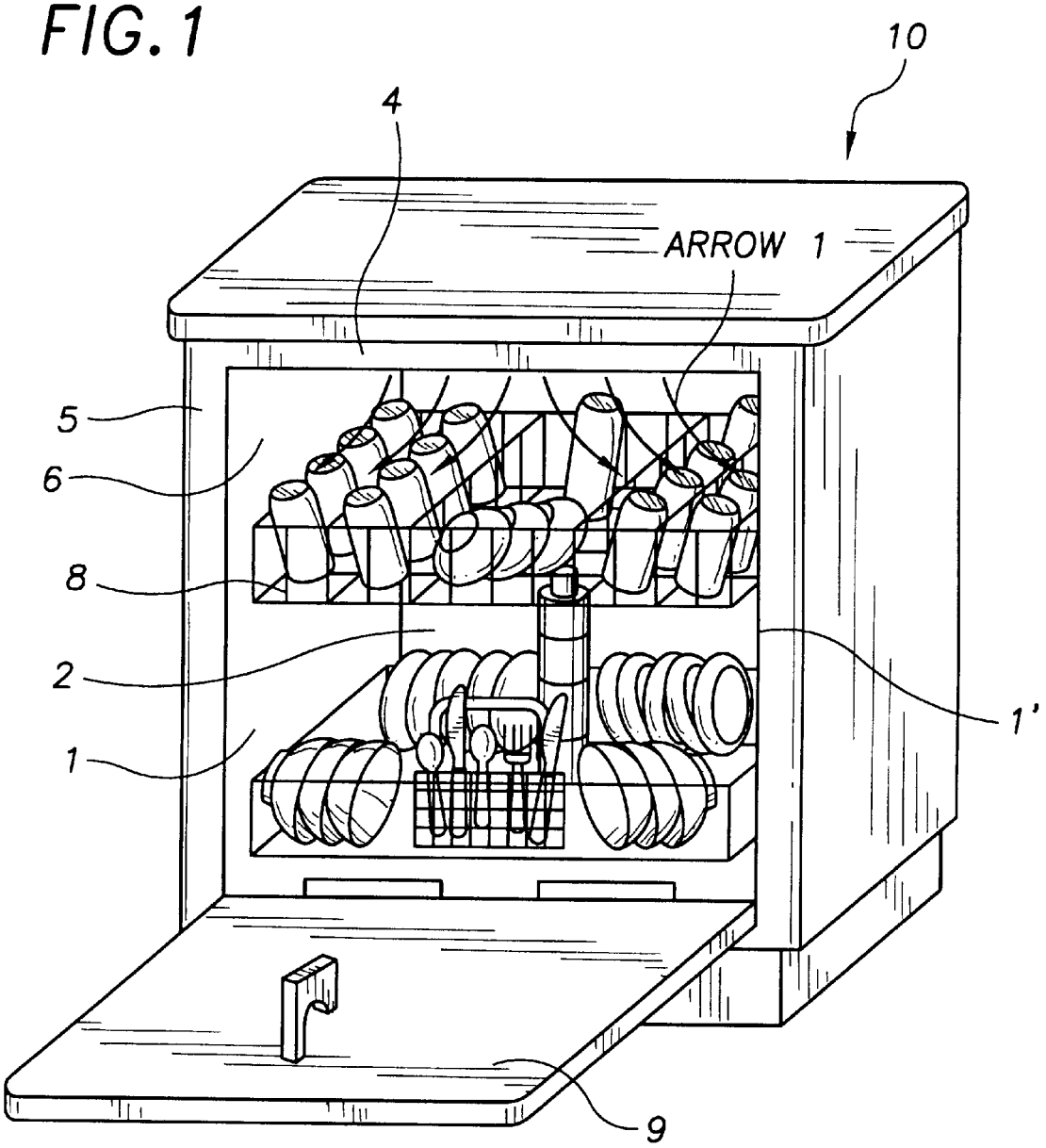
FIG. 1 illustrates the flow of injected air to the top rack of the dishwasher from the air injection system of the present invention.

Referring now to the drawings, and in particular FIG. 1, the dishwasher having a drying mode with jet-air injection, of the present invention, is designated generally by the numeral 10. As shown in FIG. 1, the jet-air injection is evenly distributed downward as shown by ARROWS 1 from top wall 4 of washing chamber 6 to the dishes placed in top rack 8. Dishwasher door 9 as hingely coupled to dishwashing unit 5 in a conventional manner and seals washing chamber 6 during the washing and drying cycles of operation.

Figure 2:
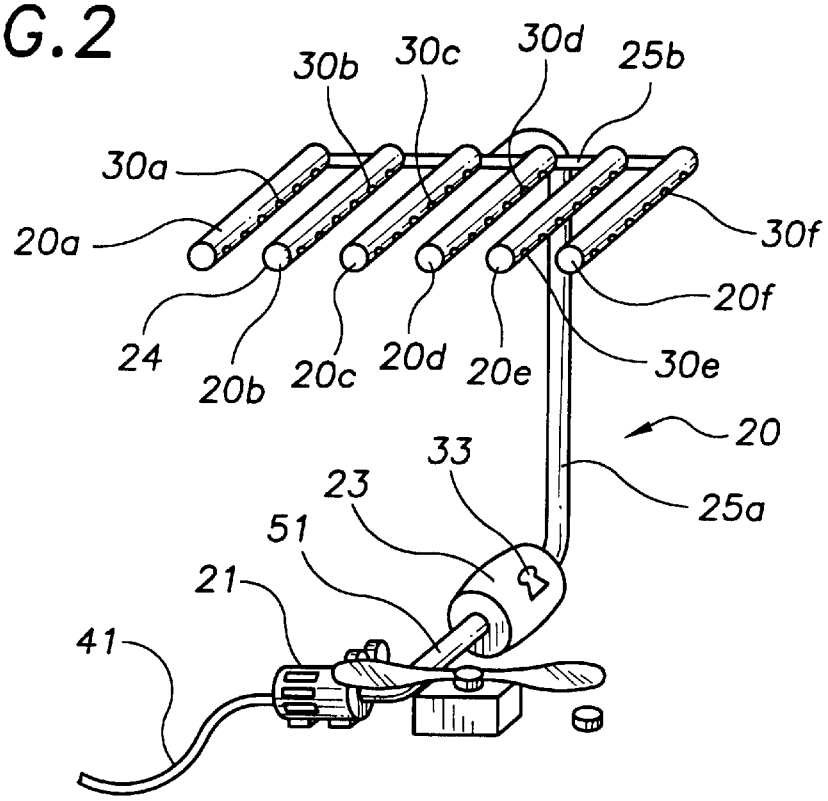
FIG. 2 illustrates a view of the air injection system of the present invention; and, FIG. 3*a* illustrates a view of the air injection system of the present invention with the dishwasher shown in outline.
Figure 3A:
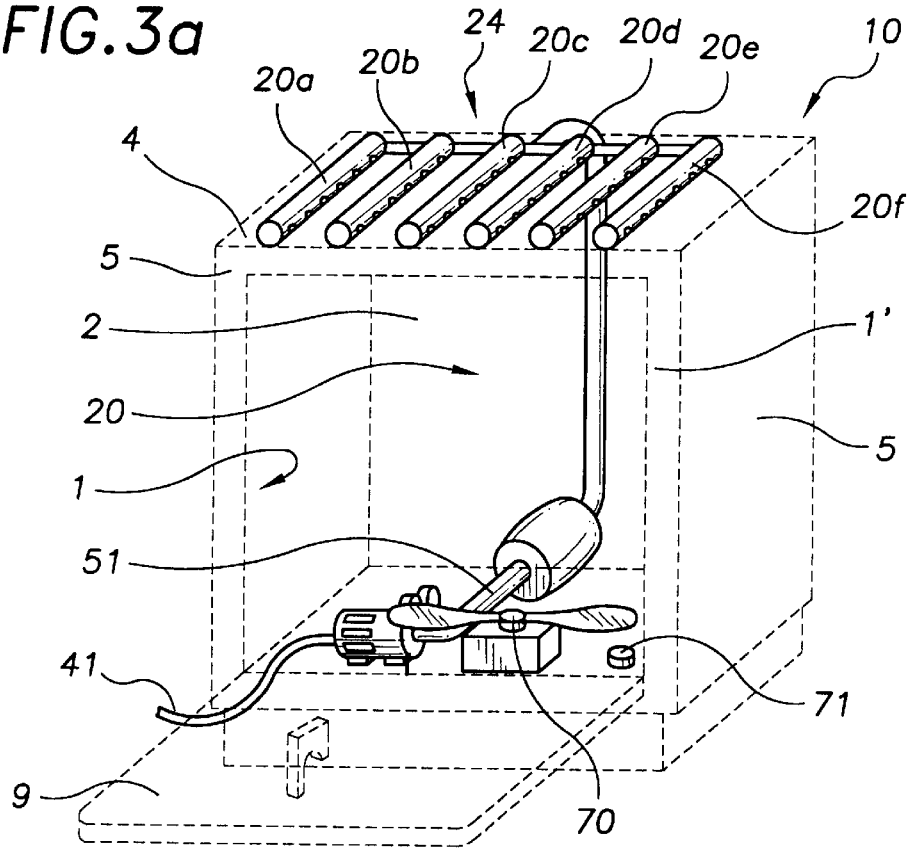
FIG. 3*b* illustrates a view of the air injection system of the present invention installed in the dishwasher wherein the top surface and the bottom floor of the dishwasher have been partially removed; and, FIG. 4 illustrates a partial view of an alternative embodiment of the injection vent.
Figure 3B:
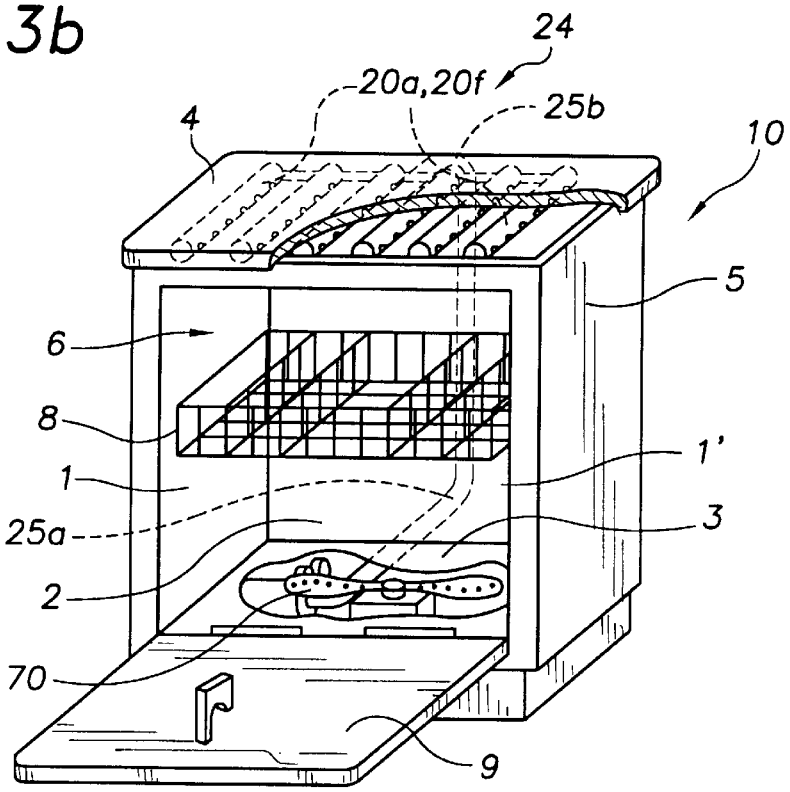

Referring now to FIGS. 2 and 3*a*–3*b*, dishwasher having a drying mode with jet-air injection 10 is comprised of a standard dishwasher unit 5 readily available by numerous manufactures and air injection system 20.

Most dishwasher units 5 readily available by numerous manufactures have several timed cycles one of which is a drying mode. As is known, dishwasher unit 5 is equipped with revolving water jet cleaner 70 for injecting water into washing chamber 6. The water level in the washing chamber is typically controlled by water level float switch 71 or other water lever controllers. The air injection system 20 preferably is powered during the drying mode cycle wherein air injection system 20 would be cooperate with the internal timing cycles of dishwasher unit 5.

Air injection system 20 comprises air compressor 21, compressed air storage tank 23, air injection manifold 24, air distribution conduits 25*a* and 25*b*.

Air compressor 21 comprises power cable 41 for powering air compressor 21 and is equipped with a pressure sensitive switch (not shown) which allows the compressor to stop when the proper pressure has been reached in compressed air storage tank 23. Air compressor 21 functions to compress the air in air storage tank 23. Air compressor 21 is coupled to compressed air storage tank 23 via conduit 51. In the preferred embodiment, air compressor 21 and compressed air storage tank 23 are located below the bottom floor 3 of washing chamber 6 of dishwasher unit 5.

Compressed air storage tank 23 is equipped with a safety check valve (not shown), as well as, an output pressure regulator 33. The compressed air output is, preferably, taken from the bottom of compressed air storage tank 23 so as to remove moisture from compressed air storage tank 23. Compressed air storage tank 23 produces an output of compressed air to air injection manifold 24 via air distribution conduits 25*a* and 25*b*. In the preferred embodiment, the output of compressed air to air injection manifold 24 is oscillating or pulsating for producing bursts of compressed air to produce forceful streams of jet-air. Nevertheless, the output of compressed air may be continuous. The bursts of compressed air are expelled to impact the dishes located in the top rack 8 of dishwasher unit 5. The continuous air flow from the compressed air storage tank 23 may be turned into pulsating air by means of a rotary device or air chopper (not shown) coupled to the output of compressed air storage tank 23. For example, the air chopper may be shaped in the form of a barrel of a revolver which spins. Thereby, as the air chopper spins air is allowed to pass through only one chamber at a time. The compressed air flow is interrupted by the turning barrel.

Compressed air storage tank 23 should have enough storage capacity of storing therein a sufficient amount of compressed air to last the duration of the preexisting drying mode of dishwashing unit 5.

Figure 4:
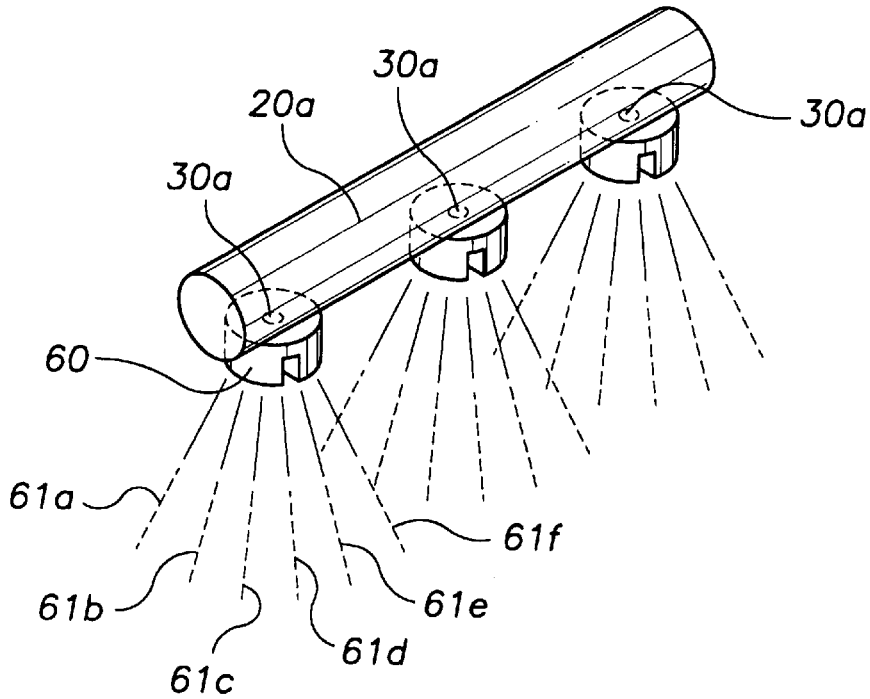

Air injection manifold 24 comprises a plurality of parallelly spaced conduits 20*a*, 20*b*, 20*c*, 20*d*, 20*e* and 20*f* each of which has formed therein a plurality of spaced air vents 30*a*, 30*b*, 30*c*, 30*d*, 30*e* and 30*f* for expelling therefrom streams of jet-air. As shown each air vent is an aperture formed in its respective conduit for expelling therefrom forceful steams of jet-air. Alternately, as shown in FIG. 4, each air vent (only 30*a* shown) of each spaced conduit (only 20*a* shown) may be provided with a spray nozzle 60 which would expel therefrom a cluster of streams of air-jets 61*a*, 61*b*, 61*c*, 61*d*, 61*e*, and 61*f* to enhance the dispersion of the jet-air to the dishes in top rack 8 of dishwasher unit 5.

As can be appreciated, the plurality of parallelly spaced conduits 20*a*, 20*b*, 20*c*, 20*d*, 20*e* and 20*f* each of which has formed therein a plurality of spaced air vents 30*a*, 30*b*, 30*c*, 30*d*, 30*e* and 30*f* significantly increases the distribution and evenness of the forced air to the dishes in top rack 8 of dishwasher unit 5. Thereby, the significant increase in the distribution of the forced air, the evenness of distribution and the forcefulness of the streams of jet-air significantly minimizes, if not, eliminates collected water in the indentations, cracks, crevices and residual water otherwise found after the standard preexisting drying mode of dishwashers.

In the preferred embodiment, the plurality of parallelly spaced conduits 20*a*, 20*b*, 20*c*, 20*d*, 20*e* and 20*f* are PVC plastic pipes or any other suitable conduits for passing therethrough air. Spray nozzle 60 may be made of metal, such as without limitation, stainless steel or plastic.

Air injection manifold 24 is coupled to compressed air storage tank 23 via air distribution conduits 25*a* and 25*b*. Air distribution conduit 25*a* is vertically disposed centrally along back wall 2 of washing chamber 6. The air distribution conduit 25*a* preferably is located on the exterior side of back wall 2. Air distribution conduit 25*a* has one end coupled to air injection manifold 24 and the other end coupled to air distribution conduit 25*b*. Air distribution conduit 25*b* is horizontally disposed along back wall 2 of washing chamber 6 wherein air distribution conduit 25*b* is coupled perpendicularly to air distribution conduit 25*a*.

Along the longitudinal length of air distribution conduct 25*b*, air distribution conduit 25*b* has perpendicularly coupled thereto the plurality of parallelly spaced conduits 20*a*, 20*b*, 20*c*, 20*d*, 20*e* and 20*f*. Thereby the plurality of parallelly spaced conduits 20*a*, 20*b*, 20*c*, 20*d*, 20*e* and 20*f* are evenly distributed along top wall 4 of dishwasher unit 5 wherein the length of each conduit of the plurality of parallelly spaced conduits 20*a*, 20*b*, 20*c*, 20*d*, 20*e* and 20*f* are perpendicular to back wall 2. Air distribution conduit 25*b* serves to substantially evenly distribute the source of bursts or continuous jet-air from compressed air storage tank 23 to the plurality of parallelly spaced conduits 20*a*, 20*b*, 20*c*, 20*d*, 20*e* and 20*f*.

Alternately, air distribution conduit 25*a* may be vertically disposed centrally on the exterior surface of side wall 1 or 1' such that the plurality of parallelly spaced conduits 20*a*, 20*b*, 20*c*, 20*d*, 20*e* and 20*f* are perpendicular to side wall 1 or 1'.

Compressed air storage tank 23 outputs continuous or bursts of streams of jet-air therefrom wherein the force of such jet-air streams forces the buildup of water collected in an indentation of upside down glasses, cup, etc., out of the indentation and downward to bottom floor 3 of washing chamber 6.

As can be readily appreciated, the steams of jet-air has a force greater than that which can be derived from circulating air via a fan. Thereby, collections of water otherwise found after the preexisting drying mode is significantly minimized, if not, eliminated.

In operation, dishwashing unit 5 is operated in a conventional manner. The jet-air injection system 20 will be timed with the pre-existing drying mode of dishwashing unit 5. The jet-air injection system 20 injects a plurality evenly distributed forceful streams of jet-air while the normal drying procedure is preformed.

It is noted that the embodiment of the dishwasher described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be Understood that the details herein are to be interpreted as illustrative and not in a limiting sense.

What is claimed is:

1. A dishwasher having a drying mode with jet-air injection comprising:

a washing chamber defined by a back wall, top wall, bottom floor, first and second side walls and dishwasher door;

a jet-air injection system which injects during said drying mode to a plurality evenly distributed forceful streams of jet-air from and air manifold coupled to said top wall of said washing chamber, wherein said air manifold comprises a plurality of parallelly spaced conduits each of which has formed therein a plurality of spaced air vents which expel downward therefrom said plurality of evenly distributed forceful streams of jet-air;

an air compressor disposed below said bottom floor of said washing chamber;

a compressed air storage tank coupled to said air compressor and disposed below said bottom floor of said washing chamber;

a first distribution conduit coupled to said compressed air storage tank and vertically coupled in the center of said back wall of said washing chamber; and a second distribution conduit perpendicularly coupled to said first distribution conduit and to said back wall of said washing chamber wherein said second distribution conduit has perpendicularly coupled thereto said plurality of parallelly spaced conduits;

each air vent of said plurality of spaced air vents having coupled thereto a spray nozzle for expelling downward therefrom a cluster of streams of jet-air;

each forceful stream of jet-air of said plurality evenly distributed forceful streams of jet-air being bursts of jet-air.

2. A dishwasher having a drying mode with jet-air injection comprising:

a washing chamber defined by a back wall, top wall, bottom floor, first and second side walls and dishwasher door;

a jet-air injection system which injects during said drying mode to a plurality evenly distributed forceful streams of jet-air from an air manifold coupled to said top wall of said washing chamber, wherein said air manifold comprises a plurality of parallelly spaced conduits, perpendicular to said back wall, each of which has formed therein a plurality of spaced air vents which expel downward therefrom said plurality of evenly distributed forceful streams of jet-air; and wherein the force of said plurality evenly distributed forceful streams of jet-air forces buildup of water collected in an indentation, cracks and crevices of upside down glasses, cups, and other dishes place in a top rack of said washing chamber out of the indentation, cracks and crevices and downward to said bottom floor of said washing chamber;

an air compressor disposed below said bottom floor of said washing chamber;

a compressed air storage tank coupled to said air compressor and disposed below said bottom floor of said washing chamber;

a first distribution conduit coupled to said compressed air storage tank and vertically coupled in the center of said back wall of said washing chamber; and a second distribution conduit perpendicularly coupled to said first distribution conduit and to said back wall of said washing chamber wherein said second distribution conduit has perpendicularly coupled thereto said plurality of parallelly spaced conduits and wherein each spaced conduit of said plurality of parallelly spaced conduits has a length which extend from one end of said top wall to a back end of said top wall and said plurality of parallelly spaced conduits are distributed from the left side of said top wall to the right side of said top wall;

each air vent of said plurality of spaced air vents having coupled thereto a spray nozzle for expelling downward therefrom a cluster of streams of jet-air;

each forceful stream of jet-air of said plurality evenly distributed forceful streams of jet-air being bursts of jet-air.

3. A dishwasher having a drying mode with jet-air injection comprising:

a washing chamber defined by a back wall, top wall, bottom floor, first and second side walls and dishwasher door;

a jet-air injection system which injects during said drying mode to a plurality evenly distributed forceful streams of jet-air from an air manifold coupled to said top wall of said washing chamber, wherein said air manifold comprises a plurality of parallelly spaced conduits, parallel to said back wall, each of which has formed therein a plurality of spaced air vents which expel downward therefrom said plurality of evenly distributed forceful streams of jet-air; and wherein the force of said plurality evenly distributed forceful streams of jet-air forces buildup of water collected in an indentation, cracks and crevices of upside down glasses, cups, and other dishes place in a top rack of said washing chamber out of the indentation, cracks and crevices and downward to said bottom floor of said washing chamber;

an air compressor disposed below said bottom floor of said washing chamber;

a compressed air storage tank coupled to said air compressor and disposed below said bottom floor of said washing chamber;

a first distribution conduit coupled to said compressed air storage tank and vertically coupled in the center of said first side wall or said second side walls back of said washing chamber; and a second distribution conduit perpendicularly coupled to said first distribution conduit wherein said second distribution conduit has perpendicularly coupled thereto said plurality of parallelly spaced conduits;

each air vent of said plurality of spaced air vents having coupled thereto a spray nozzle for expelling downward therefrom a cluster of streams of jet-air;

each forceful stream of jet-air of said plurality evenly distributed forceful streams of jet-air being bursts of jet-air.

* * * * *